United States Patent [19]

Sheinberg

[11] 4,400,213

[45] Aug. 23, 1983

[54] NOVEL HARD COMPOSITIONS AND METHODS OF PREPARATION

[76] Inventor: Haskell Sheinberg, Los Alamos, N. Mex.

[73] Assignee: The United States of America as represented by the U.S. Department of Energy, Washington, D.C.

[21] Appl. No.: 231,085

[22] Filed: Feb. 3, 1981

[51] Int. Cl.[3] ..... C22C 29/00; C22C 1/05; C22C 19/03; C22C 19/08

[52] U.S. Cl. ..... 75/238; 419/19; 419/48

[58] Field of Search ..... 75/238, 204; 419/19, 419/48

[56] References Cited

U.S. PATENT DOCUMENTS

| | | | |
|---|---|---|---|
| Re. 21,730 | 2/1941 | Schwarzkopf | 75/238 |
| 2,200,258 | 5/1940 | Boyer | 75/238 |
| 2,916,809 | 12/1959 | Schell | 75/248 |
| 3,367,398 | 2/1968 | Riley et al. | 75/262 |
| 3,386,812 | 6/1968 | Sheinberg | 75/238 |
| 3,672,936 | 6/1972 | Ehrenreich | 428/408 |
| 4,212,670 | 7/1980 | Shveikin et al. | 75/238 |

OTHER PUBLICATIONS

Schwarzkopf, et al.; "*Cemented Carbides*", The Macmillan Company, New York, (1960), pp. 188–215 and 229–231.

"Properties and Proven Uses of Kennametal Hard Carbide Alloys", Brochure of Kennametal, Inc. pp. 1–23.

"Fractometer ® System Specifications", Resource Enterprises, Salt Lake City, Utah.

Barker, L. M.; "A Simplified Method for Measuring Plane Strain Fracture Toughness", Engineering Fracture Mechanics, 1977, vol. 9, pp. 361–369.

*Primary Examiner*—Mark Bell

*Attorney, Agent, or Firm*—Elizabeth O. Slade; Paul D. Gaetjens; Richard G. Besha

[57] ABSTRACT

Novel very hard compositions of matter are prepared by using in all embodiments only a minor amount of a particular carbide (or materials which can form the carbide in situ when subjected to heat and pressure); and no strategic cobalt is needed. Under a particular range of conditions, densified compositions of matter of the invention are prepared having hardnesses on the Rockwell A test substantially equal to the hardness of pure tungsten carbide and to two of the hardest commercial cobalt-bonded tungsten carbides. Alternately, other compositions of the invention which have slightly lower hardnesses than those described above in one embodiment also possess the advantage of requiring no tungsten and in another embodiment possess the advantage of having a good fracture toughness value. Photomicrographs show that the shapes of the grains of the alloy mixture with which the minor amount of carbide (or carbide-formers) is mixed are radically altered from large, rounded to small, very angular by the addition of the carbide. Superiority of one of these hard compositions of matter over cobalt-bonded tungsten carbide for ultra-high pressure anvil applications was demonstrated.

42 Claims, 3 Drawing Figures

NOVEL HARD COMPOSITIONS AND METHODS OF PREPARATION

The invention is a result of a contract with the Department of Energy (Contract No. W-7405-ENG-36).

BACKGROUND OF THE INVENTION

The present invention relates generally to very hard compositions of matter and to methods of producing such compositions and relates more particularly to cobalt-free compositions which are very hard and to their methods of preparation.

Various carbides have long been known to exhibit very high hardness values. Tungsten carbide, for example, has a hardness value of 92–94 on the Rockwell A test (i.e., 92–94 $R_A$). However, pure carbides have also long been known to possess the property of being very brittle. To reduce that brittleness, various materials have been mixed with the carbides as binder materials, which generally act to reduce the hardness but to increase various properties such as the fracture toughness of the compositions.

A binder material which has extensively been used is cobalt, resulting in certain compositions having the very desirable combination of properties of high hardness values (88 to 94.3 $R_A$) and high fracture toughness values. (See Table 2 in Example II below). Such compositions have found widespread uses, including uses in mining and in machining operations.

However, at present, the U.S. imports about 98% of all cobalt used in this country. Furthermore, its availability has been unreliable and its price has fluctuated wildly in the past several years, ranging from about $6.40 to $50.00 per pound. Therefore, cobalt-free compositions exhibiting high hardness values and high fracture toughness values are extremely desirable now.

Researchers have long attempted to find such a cobalt-free composition. As described by Dr. Paul Schwarzkopf et al. in *Cemented Carbides,* New York: The MacMillan Company, (1960) at pages 188–190, recently there has been a successful replacement of cobalt by 3:1 Fe-Ni alloys in tungsten carbide compositions; and Schwarzkopf et al. estimated that Co as binder material can be replaced by Fe-Ni in about 90–95% of all carbides. Additionally, at pages 214–215, was the statement that in addition to the carbides of the transition metals of groups IV-VI, a number of nitrides, borides, and silicides of these metals and various intermetallic compounds and nonmetallic substances such as oxides and other ceramics, silicon carbide, and boron carbide should be considered as basis for potential tool materials. The reference added, however, that most of these substances cannot be bonded to form solids of satisfactory strength and toughness, and only aluminum oxide and boride materials can compete with cemented carbides. The reference does not teach one that a very hard composition can be produced by using only a minor amount of carbide, and in particular it does not teach using the type of carbide in an amount within the narrow range, as described below.

In U.S. Pat. No. 3,386,812, 80 v/o Ni and 20 v/o $B_4C$ are mixed and then cast to form a composition which is 93 w/o Ni and 7 w/o $B_4C$ and which has a hardness of 1100 DPH. However, a considerably harder material was sought.

Despite major R and D efforts to find substitutes for the hardest available cobalt-bonded materials, a need still exists for a very hard cobalt-free composition which requires only a minor amount of a particular carbide.

SUMMARY OF THE INVENTION

An object of this invention is a composition which is cobalt-free, which has a very high hardness value, and which utilizes only a minor amount of a particular carbide.

Another object of this invention is a method of increasing the hardness values of certain alloys.

Yet another object of this invention is articles of manufacture which do not require cobalt yet which exhibit good hardness values and good fracture toughness properties.

A further object of this invention is a cobalt-free composition which exhibits a good hardness value but which requires no tungsten and which uses only a minor amount of a particular carbide.

A still further object of this invention is to provide a method for producing cobalt-free compositions having high hardness values and other desirable properties.

Additional objects, advantages, and novel features of the invention will be set forth in part in the description which follows and in part will become apparent to those skilled in the art upon examination of the following or may be learned by practice of the invention. The objects and advantages of the invention may be utilized and attained by means of the instrumentalities and combinations particularly pointed out in the appended claims.

To achieve the foregoing and other objects and in accordance with the purposes of the present invention, as embodied and broadly described herein, the method according to the invention of producing novel and unobvious cobalt-free compositions of matter exhibiting very high hardness values comprises:

(a) combining a minor amount of boron carbide with the balance made up of a mixture consisting of either elemental powders of or prealloyed powders of (1) W (and/or Mo), (2) Fe (and/or Cu), and (3) Ni, so as to form a precursor mixture; and then (b) subjecting that precursor mixture either to (1) hot-pressing or (2) cold-pressing and sintering under conditions effective to form a hard, densified structure. Alternatively, it is believed that powders of boron and carbon can be substituted for the powdered boron carbide.

Also according to the invention, in a preferred embodiment, powder of pre-alloyed W, Ni, and Fe is used, $B_4C$ is used in an amount within the range from about 1.5 to about 4.0 weight %, and the resulting mixture is subjected to appropriate conditions of hot-pressing, thus producing a novel and unobvious cobalt-free composition of matter having a hardness value of at least 85 $R_A$ and requiring only a small amount of boron carbide. In an especially preferred embodiment, the weight percent of $B_4C$ is within the range from about 2.6 to about 2.9 weight percent, and the resulting hot-pressed (and then sintered) compositions generally have hardness values of at least 85 $R_A$ and often have hardness values higher than 90 $R_A$.

In another especially preferred embodiment, elemental powders of 90.9 Mo:6.4 Ni:2.7 Fe (by weight) are used, $B_4C$ is used in an amount of about 5.0 w/o, and the resulting mixture is hot-pressed, producing a cobalt-free composition having a hardness value of about 91.5 $R_A$ and a high theoretical density, but requiring no tungsten.

In a further aspect of the present invention, in accordance with its objects and purposes, a method of increasing the hardness of an alloy formed from W (and/or Mo), Ni, and Fe (and/or Cu) comprises: mixing powders which are used to form the alloy with a minor amount of powdered boron carbide (or powdered B and powdered C) and then subjecting the resulting mixture to either hot-pressing or cold-pressing and sintering.

In a preferred embodiment, the alloy is formed from W, Ni, and Fe in proportions described below, the amount of alloy is about 96 to about 98.5 w/o, and the minor amount of boron carbide is about 1.5 to about 4.0 w/o $B_4C$.

In another preferred embodiment, the alloy is formed from Mo, Ni, and Fe, the amount of alloy is about 93.7 to about 95 w/o, and the minor amount of boron carbide is about 5.0 to about 6.3 w/o $B_4C$.

The compositions of matter according to the invention (after they have been subjected to hot-pressing) exhibit the following advantages. Their hardnesses are much greater than the hardness of the alloy without the boron carbide, the hardnesses of some of the compositions being comparable to those of pure tungsten carbide and two of the hardest commercially available cobalt-bonded tungsten carbides. One tested composition of the invention exhibited a somewhat lower (but still good) hardness value but had also a quite good fracture toughness value. Yet another tested composition had a hardness of 91.5 $R_A$ but required no tungsten, Mo having been used. Furthermore, all of the compositions of the invention are produced without requiring cobalt and with only a minor amount of boron carbide (or boron and carbon).

The compositions according to the invention can be very advantageously used to produce any articles of manufacture which must have high hardness values, including for example tool-bits, anvils, and other articles used in mining operations. Additionally, the high fracture toughness of at least some of these materials adds to their usefulness.

DESCRIPTION OF THE PREFERRED EMBODIMENTS

Figure 1:
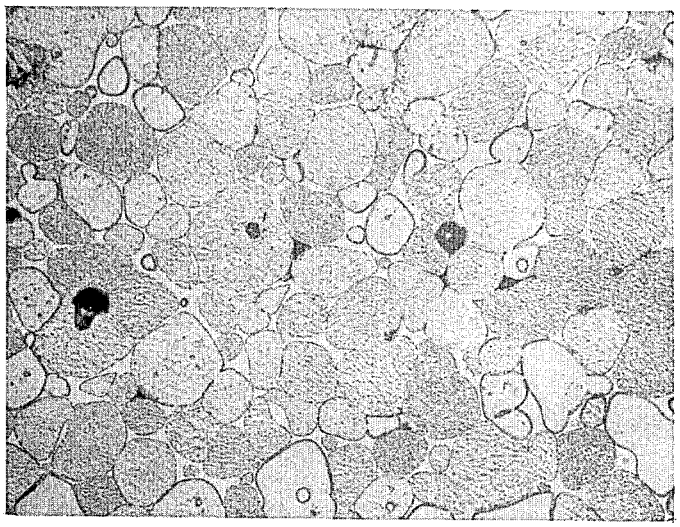
FIG. 1 is a photomicrograph at 250X of a hot-pressed standard tungsten alloy (by weight 95 W:3.5 Ni:1.5 Fe) having rounded grains and a hardness of 65 $R_A$.

The word "alloy" is used herein in accordance with the definition in the Metals Handbook, 1958 edition (American Society for Metals: Cleveland), "a substance that has metallic properties and is composed of two or more chemical elements, of which at least one is a metal."

In the practice of the invention, mixing a small amount of powdered boron carbide (or boron and carbon) with powders which are used to form certain alloy compositions and then applying heat and pressure has been found to radically alter the structure of the grains of the alloy from rounded to very angular shapes and to produce a composition having a markedly increased hardness. Extremely hard compositions have been obtained by using only a very small amount (less than about 3.5) weight % of boron carbide and without using any expensive cobalt. This achievement in itself is remarkable. Yet, besides having high hardnesses, the compositions also exhibit other desirable properties including high densities and high percentages of theoretical density (indicating low porosities). It is known that high porosity will reduce wear resistance. A particular composition of the invention having a good hardness value of about 85 $R_A$ also had a good fracture toughness (much higher than that of pure WC and of pure $B_4C$ and greater than or comparable to that of various commercial cobalt-bonded tungsten carbide compositions). See Example II below.

It is believed that the increased hardnesses of the compositions of the invention (as compared with the hardness of the alloy without boron carbide) are related to the amount of and size of the angular-shaped crystals and their compositions. Adding boron carbide to the alloy shown in FIG. 1 in a weight percent within the range from about 1.5 to about 4.0 significantly improved the hardness and also resulted in high values of density and percentages of theoretical density.

In the practice of the invention, any boron carbide can be used. However, $B_4C$ was used in the examples which follow and is preferred. Alternatively, it is believed that powdered boron and powdered carbon probably can be substituted for the boron carbide, provided they are present only in sufficient amounts to form approximately stoichiometric boron carbide in situ in an amount described below; however, other appropriate conditions have not yet been explored.

Mixed with the boron carbide (or boron and carbon) in the method of the invention is precursor mixture I (made up preferably of three components, 1, 2, and 3). It is believed that alternatively mixture I probably can be made up of only components 1 and 2; however, the appropriate conditions have not yet been explored. Additionally, it is believed that a minor amount of a binder (described below) may also be present in mixture I without leading to deleterious results.

Components 1, 2, and 3 (or 1 and 2) can either be mixed in the elemental state or can be prealloyed. However, the elemental state may be preferred by some because it does not require the additional step of prealloying.

Component 1 to be mixed with boron carbide can be selected from the group consisting of W, Mo, mixtures thereof, and alloys thereof. Although most of the examples given below were run using only tungsten as component 1, it is believed that molybdenum can be substituted for tungsten in whole or in part due to their very similar chemical natures. This belief is supported by the good results in Example 3 described below.

Component 2 is nickel.

Component 3 can be selected from the group consisting of Fe, Cu, and mixtures thereof. Although the examples given below used only iron as component 3, it is believed that Cu can be substituted on a weight basis in whole or in part for Fe due to their alloying with nickel.

When boron carbide is mixed with components 1, 2, and 3 in their elemental form and when the particle sizes are on the order of microns, the following ranges of proportions can be used. When component 1 is tungsten, about 1.5 to about 4.0 weight % of powdered boron carbide generally will be mixed with the balance made up of a mixture of components 1, 2, and 3. When component 1 is molybdenum, this range will be about 5.0 to about 6.3 w/o $B_4C$. It is believed that using less boron carbide than the weight percents recited above does not result in a sufficiently high volume concentration of hard angular grains in the final product so as to find wide utility as tool or mining bits, and it is believed that using more than the upper limits of boron carbide recited above results in diminished values of density in the final product.

The weight proportion of component 1 in mixture I will preferably lie within the range from about 90 to about 97 weight % when component 1 is tungsten. However, if molybdenum is included, the range of weight % of component 1 will most likely be different. Furthermore, the weight % of boron carbide also will probably need to be adjusted to obtain the highest hardness values.

The combined weight percents of components 2 and 3 in mixture I will preferably vary from about 3 to about 10 weight % when used with tungsten as component 1. The relative weight ratio of component 2:component 3 will preferably lie within the range from about 3.5 to about 1.5.

Although in Example I below, mixture I consisted of tungsten, nickel, and iron in weight proportions of 95:3.5:1.5 and 90:7:3, it is believed that other mixtures of these elements used to form alloys having rounded grains should also give good results, especially those formed from 90–95 w/o, W, 3.5–7 w/o Ni, and 1.5–3 w/o Fe.

The mixture of boron carbide and mixture I can next be subjected to either of the following two subsequent treatments. Treatment 1 (which is preferred because it has resulted generally in higher final product densities) is to thoroughly mix the powders, then place them into a die, and then hot-press them, simultaneously applying a high temperature and a high pressure to the mixture so as to form a fully dense article. Although the combinations of temperature and pressure can be varied over a quite wide range, generally the hot-pressing temperature should be within the range from about 1400° C. to about 1500° C.; and the hot-pressing pressure should be within the range from about 15 MPa to about 35 MPa.

The time of hot-pressing should be selected so as to achieve a fully dense, solid article. An optimal time of hot-pressing is a function of the size distribution of the elemental and boron carbide powders and the size of the object being pressed.

Alternately, if desired, the mixture of boron carbide and mixture I can be subjected to treatment 2, which is cold-pressing and sintering. For some applications, treatment 2 may be preferable to treatment 1, although treatment 2 has not yet been optimized. In treatment 2, the powders of boron carbide and of mixture I are combined (together with, if desirable, a fugitive binder which can be for example a wax dissolved in suitable solvent such as hexane, which is subsequently evaporated). A relatively strong, machinable pressing can be made, however, without a binder. The resulting mixture is next placed into a die, and pressure is applied without the simultaneous application of external heat, so as to form a cohesive but relatively fragile shape. The applied pressure should be within the range from about 150 to about 350 MPa (i.e., about 20,000 to about 50,000 psi) for a time period on the order of a fraction of a minute. This shape is then placed into a furnace where no additional external pressure is applied; and the shape is heated, driving out any binder which may be present. The temperature used in the furnace should be within the range from about 1400° C. to about 1500° C., and the time of heating will often be about one hour but is a function of the size distribution of powders employed and the size of the object being pressed.

EXAMPLES

The following examples were carried out and illustrate various preferred embodiments of the invention. Samples were prepared as described below and were subjected to various tests. Where appropriate and where possible, the same tests were run on controls (sometimes commercially available compositions); or alternately published test results are given if they were available and appropriate.

Temperatures of hot-pressing in the examples below fluctuated slightly around 1460° C. and were read with an optical pyrometer.

In the examples, it was found that a small weight loss of about 0.3 w/o to about 1.6 w/o occurred in all runs upon application of heat and pressure. The reason for the losses is not fully understood at this time, but it may be related to the amount of oxygen in the powders.

Lots A, B, and C of powdered $B_4C$ used in most of the examples below were analyzed using spectroscopic methods. For lot A, the boron content was determined to be 79.0 weight percent, the total carbon content was 19.3 weight percent, and the free carbon content was 0.1 weight percent. In lot B, the total boron content (calculated as normal boron) was 78.2 weight percent and the total carbon content was 21.4 weight percent. For lot C, the total boron content was 76.3 weight percent, the total carbon content was 22.8 weight percent, the free carbon content was 3.3 weight percent, and the water-soluble boron content was 70 parts per million. Additionally, elemental analyses for trace elements were done for each lot of $B_4C$. However, other than oxygen, these impurities did not appear to be present in sufficient quantities to affect appreciably the properties of the invention compositions.

In the examples below prior to each determination of a hardness value on a specimen cylinder, the ends of the cylinder were ground flat and parallel by removing a 0.003–0.004 inch stock from each end.

Example IA

In this example and in all hot-pressings that follow, solid cylinders (1.25 in. diameter and 1.0 in. long) were prepared from compositions according to the invention; and their Rockwell A hardness values were measured. The boron carbide used was $B_4C$ and its weight % was varied from 1.52 up to 3.0. Components 1, 2, and 3 (making up mixture I) were powders of tungsten, nickel, and iron; and they were present in mixture I in weight proportions 95:3.5:1.5, respectively. In all runs (except run 4) the powders combined in mixture I were in the elemental state, whereas in run 4 the powders were in the form of a prealloyed powder. The average size of the $B_4C$ powder was about 3.5 μm, as measured with a Fisher Sub-Sieve Sizer; and the $B_4C$ powder was from lot A (described above). This powder was of high purity, essentially stoichiometric $B_4C$. The average sizes of the powders of elemental tungsten, elemental iron, and elemental nickel were 5.0 μm, 5.0 μm, and 4.6 μm, respectively, and were of 99.9% pure grade. The iron and nickel were of the carbonyl type.

The powders were thoroughly mixed together by standard means.

All runs (except run 5) employed hot-pressing in an argon atmosphere, whereas run 5 used cold-pressing (without a binder) and sintering in a hydrogen atmosphere.

Ends of hot-pressed cylinders were ground flat and parallel prior to measurement of hardness; approximately 0.004 inch of material was removed from each end during grinding.

The values of hardness were measured in accordance with ASTM Test No. B294-76 (which prescribes the Rockwell A hardness test) and were made on a Rockwell Hardness Tester, Model 4JR, manufactured by Wilson Mechanical Instrument Division of American Chain and Cable Co., Inc. Hardness was measured at five positions on each of the six samples, the five values obtained at points positioned substantially equidistantly along a radius at one end of each sample cylinder. The range of the hardness values and the average hardness value for each cylinder, as well as details of the preparation of the samples, are summarized in Table 1A. Also given are measurements of density of the samples and the percentages of theoretical density. Theoretical density (TD) in all examples was determined as it would be found for a mixture:

$$TD = \frac{\sum_i \text{weight component } i}{\sum_i \text{volume component } i}.$$

Thus, here, $$TD = \frac{\text{wt W} + \text{wt Ni} + \text{wt Fe} + \text{wt B}_4\text{C}}{\frac{\text{wt W}}{19.3} + \frac{\text{wt Ni}}{8.9} + \frac{\text{wt Fe}}{7.87} + \frac{\text{wt B}_4\text{C}}{2.52}}$$

From the results in Table 1A, it can clearly be seen that the hardness values of samples 2 and 3 were exceptionally high and consistently high (the small variations in values indicating a high hardness throughout the material). Furthermore, the percentages of theoretical densities for runs 2 and 3 were the highest for these six runs, these values and the high density values in runs 2 and 3 being significant because they indicate low porosity.

When one compares runs 5 and 3, one can validly conclude that hot-pressing produced a product having a much higher average hardness, a much smaller range of hardness values, and a higher density than when cold-pressing and sintering were used. However, it is believed that the conditions for cold-pressing and sintering will also result in good products if those conditions can be optimized, although no cold-pressed and sintered product having an average hardness greater than 81 $R_A$ has yet been obtained.

Furthermore, from runs 2 and 3 it appears that in order to obtain the hardest possible product, one should employ carbon carbide in a weight % lying between about 2.5 and about 2.8 when the boron carbide is $B_4C$ and when W is used.

It should be noted that the articles which were produced in these six runs contained a few minor imperfections (which were bubbles). It is believed that these imperfections were probably due to some boric oxide present in the particular lot (lot A) of boron carbide which was used in Example IA. Heating the boron carbide in boiling water and vacuum drying it prior to blending with mixture I and then hot-pressing resulted in removal of all visible bubbles from a hot-pressed specimen.

TABLE 1A

| Run | $B_4C$ (Calc.) | | Mixture I W + Fe + Ni | | Pressing Conditions: Max. Temp. | Pressure | Time @ Temp. + Pressure | Density | % of Theo. | Hardness ($R_A$) | |
|---|---|---|---|---|---|---|---|---|---|---|---|
| # | v/o | w/o | v/o | w/o | (°C.) | (psi) | (min.) | (g/cc) | Dens.*** | Range | Avg. |
| 1 | 10.01 | 1.52 | 89.99 | 98.48 | 1460 | 3100 | 30 | 17.02 | 102.6 | 84.0–87.5 | 85.5 |
| 2 | 15.60 | 2.50 | 84.40 | 97.50 | 1455 | 3100 | 30 | 15.72 | 104.6 | 92.0–93.0 | 92.6 |
| 3 | 16.93 | 2.75 | 83.07 | 97.25 | 1450 | 3100 | 30 | 15.52 | 104.5 | 93.0–94.0 | 93.2 |
| **4 | 10.01 | 1.52 | 89.99 | 98.48 | 1450 | 3100 | 30 | 16.70*<br>16.80 | 100.7<br>101.3 | 84.5–86.0 | 85.5 |
| 5 | 16.93 | 2.75 | 83.07 | 97.25 | 1470 | cold-pressed 50K | sintered 75 min. in $H_2$ | 14.57 | 93.89 | 60.5–77.0 | 70.5 |
| 6 | 18.22 | 3.0 | 81.78 | 97.0 | 1460 | 4100 | 60 | 13.21 | 86.28 | 71.0–77.0 | 73.6 |

*Value was determined from physical dimensions; all other density values were determined by immersion.
**Pre-alloyed powders of W, Fe, and Ni were used; in all other runs elemental powders were used.
***Theoretical density calculated by rule of simple mixtures, values greater than 100 indicating probable formation of compounds.

Figure 2:
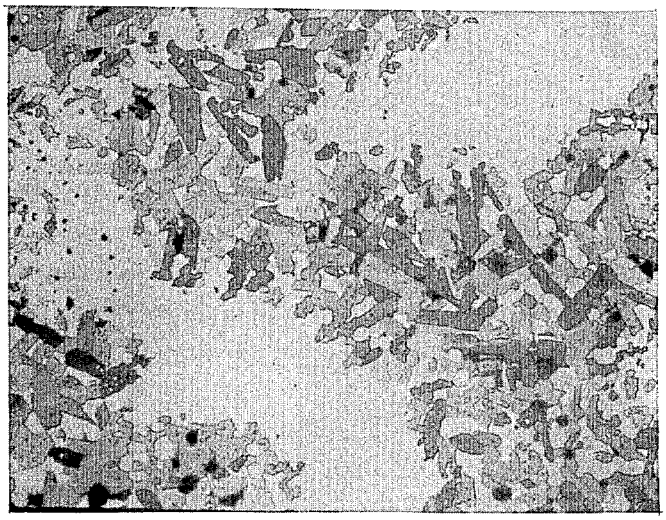
FIG. 2 is a photomicrograph at 250X of a composition according to the invention having a hardness of 84.0–87.5 $R_A$ prepared by hot-pressing a mixture of 10 v/o (1.52 w/o) $B_4C$ and 90 v/o of the alloy of FIG. 1, showing very angular grains occupying about 40% of the area observed. The remainder of the area is believed to be probably occupied by unreacted alloy.
Figure 3:
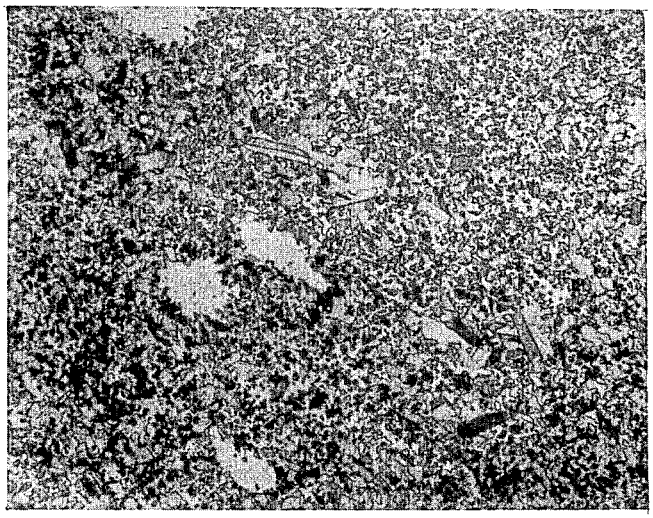
FIG. 3 is a photomicrograph at 250X of a composition according to the invention (Run 3, below) prepared by hot-pressing a mixture of 2.75 w/o $B_4C$ and 97.25 w/o of the alloy of FIG. 1, showing very small angular grains occupying about 95% of the area observed. The hardness was 93.0–94.0 $R_A$.

FIG. 2 shows the microstructure of run 1, and FIG. 3 shows the microstructure of run 3.

Example IB

In this example, cylindrical shapes were prepared in a manner similar to that used in Example IA. All hot-pressing runs were hot-pressed in an argon atmosphere. In this example, the lots of $B_4C$ were varied (and thus the stoichiometry and purity varied slightly). The relative amounts by weight of tungsten, iron, and nickel were also varied, although the sizes of the powders of these materials were the same as in Example IA. In runs 16, 17, 18, and 22, mixture I (by w/o) was 90 W:7 Ni:3 Fe; in all other runs in Table 1B, it was 95 W:3.5 Ni:1.5 Fe. In Table 1B below, the important variables are listed, as well as the measured values of density, theoretical density, and hardness. The average particle size of the $B_4C$ was 3.5 μm in lot A and 9.8 μm in lot B; and in lot C the range of the sizes was (−63 μm+38 μm). In runs using lots B and C, no bubbles were observed in any of the products. Hardness values were determined as described in Example IA; and those values which are underlined are the resulting values in runs where one of the five measured hardness values was in doubt and was discarded.

From the data in Table 1B, one can see that the highest percentages of theoretical density were obtained generally when the weight % of $B_4C$ in mixture I was in the range from about 2.6 to about 2.8.

In some of these runs, the hot-pressed samples were subjected to a further procedure after hardness was tested. This procedure was to sinter hot-pressed samples at a temperature of 1480° C. for a time period of 30 min. in a hydrogen atmosphere and to redetermine hardness values. Additionally, in some runs, the samples were then resintered and the hardness was again determined.

TABLE 1B

| Run # | Lot $B_4C$ | $B_4C$ v/o | $B_4C$ w/o | Mixture I (W + Fe + Ni) w/o | Density (g/cc) | % of Theor. Dens. | Hardness Max. | Hardness Avg. | After Sinter, Hardness Max. | After Sinter, Hardness Avg. | After Resinter, Hardness Max. | After Resinter, Hardness Avg. | Hot-Pressing Conditions Max. Temp. T (°C.) | Hot-Pressing Conditions Pressure P (psi) | Hot-Pressing Conditions Time @ T + P (min) |
|---|---|---|---|---|---|---|---|---|---|---|---|---|---|---|---|
| 7 | A | 16.04 | 2.58 | 97.42 | 16.28 | 104.04 | 92.9 | 86.5 | 92.2 | 90.3 | 92.7 | 91.6 | 1450 | 3600 | 30 |
| 8 | A | 16.48 | 2.67 | 97.33 | 16.20 | 104.0 | 93.4 | 92.1 | | | | | 1450 | 3600 | 30 |
| 9 | A | 17.36 | 2.83 | 97.17 | 15.36 | 99.47 | 74.7 | 67.3 | 78.0 | 76.5 | 89.1 | 84.7 | 1455 | 3100 | 30 |
| 10 | A | 17.79 | 2.92 | 97.08 | 14.98 | 97.41 | 80.8 | 75.9 | | | | | 1460 | 4600 | 60 |
| 11 | B | 16.48 | 2.67 | 97.33 | 15.80 | 101.43 | 74.2 | 64.9 | | | | | 1455 | 3100 | 30 |
| 12 | B | 17.36 | 2.83 | 97.17 | 14.83 | 96.09 | 83.9 | 77.9 | | | | | 1460 | 4600 | 100 |
| 13* | A | 16.48 | 2.67 | 97.33 | 16.02 | 102.83 | 92.3 | 89.5 | 91.7 | 89.6 | | | 1460 | 3100 | 30 |
| 14* | A | 17.36 | 2.83 | 97.17 | 15.68 | 101.57 | 87.1 | 85.3 | 93.8 | 91.5 | | | 1455 | 3100 | 30 |
| 15** | A | 17.36 | 2.83 | 97.17 | 15.79 | 102.24 | 80.7 | 70.8 | 92.8 | 87.7 | | | 1465 | 3100 | 30 |
| 16 | B | 30.24 | 6.0 | 94 | 10.30 | 81.08 | 68.3 | 60.6 | 70.2 | 64.7 | 71.5 | 60.9 | 1475 | 4800 | 30 |
| 17 | A | 30.24 | 6.0 | 94 | 10.65 | 83.81 | 74.0 | 70.0 | | | 74.2 | 70.4 | 1475 | 4800 | 60 |
| 18 | C | 22.08 | 4.0 | 96 | 13.19 | 94.96 | 90.0 | 89.4 | 88.9 | 88.4 | | | 1490 | 4800 | 120 |
| 19 | C | 17.36 | 2.83 | 97.17 | 15.03 | 97.32 | 88.3 | 83.4 | 87.9 | 82.8 | 88.6 | 85.7 | 1470 | 4800 | 90 |
| 20 | C | 16.48 | 2.67 | 97.33 | 15.90 | 102.10 | 80.3 | 70.4 | 82.8 | 79.1 | 92.9 | 87.5 | 1460 | 3100 | 30 |
| 21* | C | 16.48 | 2.67 | 97.33 | 15.94 | 102.3 | | | | | | | 1465 | 3100 | 30 |
| 22 | C | 17.36 | 3.0 | 97.0 | 15.36 | 105.4 | | | | | | | 1475 | 3100 | 30 |
| 23 | C | 17.2 | 2.79 | 97.21 | 15.31 | 99.0 | 81.5 | 73.0 | | | | | 1460 | 3000 | 30 |

*Pre-alloyed powders were used in Mixture I. In all other runs, elemental powders were used.
**Powders were preliminarily $H_2$ reduced.

From the hardness data in Tables 1A and 1B it can be seen that when the w/o of $B_4C$ had a value within the range from 2.67 to 2.83, the hardness of the hot-pressed samples was often higher than 90 $R_A$. See runs 2, 3, 7, 8, and 13. And if the hardness of the hot-pressed samples was less than 90 $R_A$, the value was generally improvable to at least about 85 $R_A$ by subsequent sintering or sinterings. See runs 9, 14, 15, and 20. In run 19 the hardness of the hot-pressed product was originally between about 83 and 88 $R_A$, and it improved slightly after subsequent resintering. In runs 11, 12, and 23, although the w/o of $B_4C$ was in the preferred range, the hardness values were unusually low, possibly due to improper but unnoticed hot-pressing conditions or to the purity or stoichiometry of the particular lot of $B_4C$ that was used. However, it is believed that the hardness would have been at least 85 $R_A$ if hot-pressing conditions has been optimum and/or if subsequent sintering(s) of the hot-pressed products had been done in these runs. Additionally, it is believed that if additional material had been removed the surface porosity would have been reduced and higher values of hardness would have been obtained.

Given in Table 1C is a summary of hardness values for various materials, with the sources indicated. The two cobalt-bonded tungsten carbides listed have the highest known hardness values of any cobalt-bonded tungsten carbides. The alloy 95 W:3.5 Ni:1.5 Fe is a well-known standard machinable tungsten alloy, having a microstructure as shown in FIG. 1.

It can clearly be seen from the data shown in Table 1C that the hardnesses of invention runs 2 and 3 are much higher than that of machinable 95 W:3.5 Ni:1.5 Fe alloy and that they are almost as high as those of the non-machinable pure tungsten carbide and the two hardest known commercially available cobalt-bonded tungsten carbides.

TABLE 1C

| Material | Hardness ($R_A$) |
|---|---|
| Pure WC | 92–94[a] |
| Commercial Cobalt-bonded WC | |
| Kennametal® K11[b] | 93.0[c] |
| Kennametal® K602[b] | 94.3[c] |
| Alloy (by W/O) 95W:3.5Ni:1.5Fe | 65[d] |
| Invention | |
| Run 1 | 84.0–87.5[d] |
| Run 2 | 92.0–93.0[d] |
| Run 3 | 93.0–94.0[d] |

[a]Schwarzkopf et al., cited above, at p. 138.
[b]Produced by Kennametal Inc., Latrobe, PA.
[c]*Properties and Proven Uses of Kennametal Hard Carbide Alloys.* a brochure published by Kennametal Inc., Latrobe, PA. 1977, at pp. 14–15.
[d]Measured by method described in Example IA.

Example II

In this example, the invention composition of run 1 in Example IA and samples of hot-pressed WC-4% Co and pure $B_4C$ were subjected to fracture toughness tests, in which fracture toughness was measured by use of a Fractometer I®; and samples were in the form of short rods, described below. The samples were subjected to a test which is described in L. M. Barker, "A Simplified Method for Measuring Plane Strain Fracture Toughness," *Engineering Fracture Mechanics,* 1977, vol. 9, pp. 361–369; and that reference is hereby incorporated herein by reference. Although this test is not yet an ASTM test, it is in the process of becoming a standard test. The operation of the Fractometer I system is further described in a brochure entitled *Fractometer System Specifications,* which is sent by Resource Enterprises (400 Wakara Way, Salt Lake City, Utah) to purchasers of the Fractometer I System #4201. It is believed that $K_{IC}$ in the quotation below is meant to be $K_{ICSR}$ because the test is not yet an ASTM test. The Flatjack discussed below is an ultra-thin, inflatable, stainless-steel bladder which is pressurized with either water or mercury. The brochure reads:

Tests to determine $K_{IC}$ of a material are reduced to a simple operation. To test a sample, a "V" shaped slot in the specimen is produced with the aid of a special fixture mounted on the FRACTOMETER Specimen Saw. When ready for testing, the specimen slot is seated completely over the Flatjack. Fluid pressure supplied by the FRACTOMETER Intensifier is applied to the Flatjack which loads the inside of the slot. The crack initiated at the point of the "V" is stable and requires increasing pressure to grow until the critical crack length is achieved. Thereafter the pressure decreases with crack growth. Measurement of peak pressure is electronically converted to critical stress intensity, $K_{IC}$, and instantaneously displayed on the digital Stress Intensity Meter. A digital memory records the specimens's $K_{IC}$ value automatically, and the $K_{IC}$ can be recalled to the display any time after the test.

The samples were tested by Resource Enterprises in accordance with the procedure specified in that brochure (referred to above). For each sample tested, the value of $a_o$ (which is the depth within the slot to the point of the "V" and which is shown on page 362 of the Barker reference cited above) was 6.35±0.75 mm, the value of the chord angle $2\theta$ (where $\theta$ was also shown on page 362 of Barker) was $58° \pm \frac{1}{2}°$; the slot thickness was 0.36±0.025 mm; the rod diameter was 12.70±0.025 mm; and the rod length was 19.05±0.075 mm.

Presented in Table 2 is a summary of the results of these fracture toughness tests. Also presented are fracture toughness data (published in the brochure cited above) for various commercially available cobalt-bonded tungsten carbide compositions.

From the data in Table 2, it can clearly be seen that the fracture toughness of run 1 of the composition according to the invention is substantially higher than the fracture toughness of hot-pressed tungsten carbide-4% Co and of pure boron carbide and is comparable to the values for cobalt-bonded tungsten carbides reported in the *Fractometer System Specifications.* Additionally, the average hardness value of run 1 (85.5 $R_A$) is quite good. It is emphasized that this desirable combination of properties has been achieved without using any cobalt and with only a minor amount of boron carbide.

Example III

In this example, molybdenum was substituted for tungsten in the same molar concentration as tungsten was used in the alloy 95 W:3.5 Ni:1.5 Fe. Thus, molybdenum was present in the powdered alloy in an amount corresponding to 90.9 weight percent Mo; and the weight percent of nickel was 6.4, and the weight percent of iron was 2.7. The weight percent of $B_4C$ which was combined with the balance made up of the powdered molybdenum alloy was varied from 5.0 to 6.3 w/o. All of the four samples were subjected to hotpressing, with a maximum temperature of 1460° C., an applied pressure of 2600 psi, for a time of 30 min. In the first run (run #25), an incorrect charge was used in loading the die; and only the percent of theoretical density was determined for this sample. In the remaining three samples, hardness was determined as was described above in Example IA, and the values are given below in Table 3. Additionally, in the fourth run (see run 28), after hot-pressing, the sample was subjected to sintering at a temperature of 1480° C.; and hardness was tested again after this procedure. The results are shown below in Table III, and it appears that here the hardness decreased slightly after this procedure of sintering.

TABLE 2

| Material | Fracture Toughness $K_{ICSR}$ (Megapascals · $\sqrt{\text{meters}}$) | Number of Tests | Standard Deviation (%) |
|---|---|---|---|
| Boron carbide | 3.35 | | |
| Tungsten carbide-4% Co | 7.81 | | |
| Invention Run 1 | 12.20 | | |
| Commercial cobalt-bonded WC | 8.96 | 2 | 1.6 |
| | 10.80 | 3 | 2.3 |
| | 6.94 | 3 | 1.4 |
| | 7.78 | 3 | 2.3 |
| | 7.70 | 3 | 1.0 |
| | 9.51 | 3 | 2.5 |
| | 6.17 | 3 | 0.8 |
| | 10.58 | 3 | 1.6 |
| | 11.96 | 4 | 3.9 |
| | 13.65 | 3 | 0.4 |
| | 16.08 | 5 | 0.7 |

From the results in Table 3, one can observe that very good hardness values were obtained by using only a minor amount of $B_4C$, using molybdenum instead of tungsten, and using no cobalt.

Example IV

In this example, two anvils were made of the invention material [2.666 w/o $B_4C$(lot C)-97.334 w/o (95 w/o W-3.5 w/o Ni-1.5 w/o Fe)] and were subjected to a test to determine the ability of the anvil material to sustain high pressure without deformation. Additionally, two anvils made from Kennametal® K-68 cobalt-bonded tungsten carbide and two anvils made from General Electric grade 779 cobalt-bonded tungsten carbide served as controls; and each set of anvils was individually subjected to the test described below. Each anvil was cylindrically symmetric, having a diameter of 0.484 inch, a height of 0.515 inch, a bottom flat circular surface of diameter of 0.484 inch, and a top flat circular surface of diameter 0.100 inch. The configuration of each set of anvils had the shape of a Bridgman anvil with a 0.100 inch flat.

In each test, one anvil of a set was positioned above the other anvil of the set in the following way. The lower anvil was placed with its large, flat end down; and on top of this anvil on the center flat surface was mounted a 0.100 inch diameter annulus made of pressed boron powder.

TABLE 3

| Run # | $B_4C$ v/o | $B_4C$ w/o | Mo w/o in Alloy | % of Theo. Dens. | Hardness Max. | Hardness Avg. | Hardness after sintering Max. | Hardness after sintering Avg. |
|---|---|---|---|---|---|---|---|---|
| 25 | 17.4 | 5.0 | 90.9 | 98.2 | | | | |
| 26 | 17.4 | 5.0 | 90.9 | 103.8 | 91.9 | 91.5 | | |
| 27 | 20.0 | 5.9 | 90.9 | 105.3 | 91.8 | 90.7 | | |
| 28 | 25.0 | 6.3 | 90.9 | 100.7 | 90.6 | 89.5 | 89.0 | 87.5 |

In the center hole of the annulus was placed a specimen of NaF of which the compression has been well determined. The second anvil of the set was then placed onto the assembly with its large flat end up; and an external load of 48,000 psi was applied at the top of the upper anvil. Then X-ray diffraction patterns were taken laterally through the boron annulus. From the diffraction pattern of the NaF, the actual peak pressure at the sample boundary (which was in contact with the boron annulus) was determined by means well known to those in high pressure work, as described in John C. Jamieson, "Crystal Structures of High Pressure Modifications of Elements and Certain Compounds, A Progress Report," *Metallurgy at High Pressures and High Temperatures,* Vol. 22, Metallurgical Society Conferences, Editors K. A. Gschneidner et al., Gordon and Breach Science Publishers, New York, 1964, pp. 201–228. The load was then removed, and the deformation across the 0.100 inch diameter flat which bore the peak load was measured. The results are given in Table 4 below. It should be noted that none of the anvils failed.

TABLE 4

| Sample | Peak Pressure (kbar) | Average Deformation (μm) |
|---|---|---|
| Invention | 145 | 1.3 |
| General Electric (Control) | 124 | 14 |
| Kennametal K-68 (Control) | 112 | 11 |

From these results, it is clear that the invention material is superior to the tested prior art controls for sustaining very high pressures with minimal plastic deformation; and to the limit of these test runs, the invention material appears comparable in resistance to fracture. Thus, the invention material is useful in producing superior high pressure anvils and should be a superior diamond support material.

Example V

In this example, a pre-alloyed powder of tungsten and molybdenum was used instead of solely tungsten or solely molybdenum to form a composition according to the invention. The alloy powder was a coarse nomimal −200 mesh powder made by G.T.E. Sylvania, Precision Materials Group, Chemical and Metallurgical Div., Towanda, Pa. The alloy was formed from 80 w/o tungsten and 20 w/o molybdenum; and it was used to form a first mixture made of 95 w/o alloy, 3.5 w/o Ni, and 1.5 w/o Fe. This first mixture was then mixed in an amount of 97.334 w/o with 2.666 w/o of $B_4C$ from lot C; and the resulting mixture was hot-pressed to about 100.6% of theoretical density. The average hardness (5 readings) was 89.3 $R_A$ with a maximum value of 90.1 $R_A$ after subsequent sintering.

Example VI

In this example, instead of using $B_4C$, control runs using only B and only C were run, as well as an invention run using a mixture of B and C in proportion to form $B_4C$. Each was mixed with a powder of 95 w/o W-3.5 w/o Ni-1.5 w/o Fe alloy in weight percentages as specified in Table 5 below, and the percent of theoretical density was determined for each run. For the two control runs, the average Rockwell A hardness was determined by the method described in Example IA.

TABLE 5

| Run | Composition | Density % T.D. | Hardness $R_A$ |
|---|---|---|---|
| Control 1 | 2.83 w/o B-97.17 w/o alloy | 104 | 87.4 |
| Control 2 | 2.50 w/o C-97.50 w/o alloy | 89.3 | 78.4 |
| Invention | 2.08 w/o B-0.58 w/o C-97.334 w/o alloy | 101.7 | |

From the results in Table 5, one can validly conclude that B is a major contributor to the hardness. Also, because the percentage of theoretical density for the invention run is quite high, it can reasonably be expected tht the hardness of that run will be quite high, although the value has not yet been experimentally determined.

Example VII

In this example, hardness of a particular hot-pressed composition according to the invention [2.5 w/o $B_4C$(lot D)-97.5 w/o (95 w/o W-3.5 w/o Ni-1.5 w/o Fe)] was determined on both the Rockwell A scale and on the DPH scale. The maximum Rockwell A hardness reading was 93.3 $R_A$. Lot D was a commercial grade $B_4C$ having a Fisher average particle size of 4.1 μm. It had a boron content of 76.5 w/o, a total carbon content of 21.2 w/o, a free carbon content of 1.3 w/o, and a water-soluble boron content of 0.16 w/o. The DPH average values were 1790 DPH for the small grains in the structure and 2325 DPH for the large grains, both values of which are significantly higher than the value of 1100 DPH which was obtained for the prior art Ni-$B_4C$ alloy described above.

Example VIII

In this example, the hardness of a hot-pressed invention cylinder specien made of [2.666 w/o $B_4C$(lot A)-97.334 w/o (95 W-3.5 Ni-1.5 Fe)] was determined after each of two surface layers were removed. The $B_4C$ here used had been water-washed before blending to remove $B_2O_3$. After removing the usual 0.003–0.004 inch stock from each end, the average hardness on one end was measured to be 74.5 $R_A$ (five readings) and on the other end was 74.4 $R_A$ (five readings). After removal of another 0.020 inch stock on one surface, the average of nine hardness readings was 93.5 $R_A$, with values ranging only from 93.2 to 93.8 $R_A$. It is believed that a thin case forms during hot-pressing and that this case is either not as hard as or more porous than the substantive inner portion of the cylinder.

The foregoing description of the preferred embodiments of the invention has been presented for purposes of illustration and description. It is not intended to be exhaustive or to limit the invention to the precise forms disclosed, and obviously many modifications and variations are possible in light of the above teachings. The embodiments were chosen and described in order to best explain the principles of the invention and their practical application to thereby enable others skilled in the art to best utilize the invention in various embodiments and with various modifications as are suited to the particular uses contemplated. It is intended that the scope of the invention be defined by the claims appended hereto.

What is claimed is:

1. A precursor mixture useful for producing a very hard composition without requiring cobalt, said precursor mixture consisting essentially of:

(a) a minor amount of a boron carbide component selected from the group consisting of
  (i) boron carbide and
  (ii) boron and carbon, both present in amounts effective to form boron carbide in situ; and (b) a major amount of a second mixture consisting of
  (i) a first amount of a first component selected from the group consisting of tungsten, molybdenum, mixtures thereof and alloys thereof, (ii) a second amount of a second component which is nickel, and (iii) a third amount of a third component selected from the group consisting of iron, copper, and mixtures thereof, wherein said minor amount is an amount corresponding to a weight percent of said precursor mixture within the range from about 1.5 to about 4.0 when said first component is tungsten and within the range from about 5.0 to about 6.3 when said first component is molybdenum, wherein said major amount is a weight percent of about 100 minus said minor amount, wherein said first amount is an amount within the range from about 90 to about 97 weight percent of said major amount when said first component is tungsten, wherein the sum of said second amount and said third amount is within the range from about 3 to about 10 weight percent of said major amount when said first component is tungsten, wherein molybdenum can be substituted for tungsten on a mole-for-mole basis, and wherein said first amount, said second amount, and said third amount are amounts which are effective to result in a composition having an average hardness of at least about 85 Rockwell A when said precursor mixture is subjected to appropriate hot-pressing conditions.

2. A composition according to claim 1 wherein the relative weight ratio of said second amount to said third amount lies within the range from about 3.5 to about 1.5.

3. A composition according to claim 2, wherein said first component is tungsten, wherein said third component is iron, wherein said boron carbide is $B_4C$, wherein the sizes of particles of tungsten, nickel, iron, and $B_4C$ are on the order of microns, and wherein said minor amount is present is an amount corresponding to a weight percent of said precursor mixture within the range from about 2.0 to about 4.0.

4. A composition according to claim 3, wherein said minor amount is an amount corresponding to a weight percent within the range from about 2.5 to about 3.0.

5. A precursor mixture useful for producing a very hard composition without requiring cobalt, said precursor mixture consisting essentially of:

(a) a minor amount of a boron carbide component selected from the group consisting of (i) boron carbide and (ii) boron and carbon, both present in amounts effective to form boron carbide in situ, wherein said boron carbide is $B_4C$; and (b) a major amount of a second mixture consisting of (i) a first amount of a first component which is tungsten, (ii) a second amount of a second component which nickel, and (iii) a third amount of a third component which is iron, wherein said minor amount is an amount corresponding to a weight percent of said precursor mixture within the range from about 2.5 to about 3.0, wherein said major amount is a weight percent of about 100 minus said minor amount, wherein the sizes of particles of tungsten, nickel, iron, and $B_4$ are on the order of microns, and wherein said tungsten, said nickel, and said iron are present in said second mixture in a weight ratio of 90–95 W:3.5–7 Ni:1.5–3 Fe.

6. A composition according to claim 5, wherein said tungsten, said nickel, and said iron are present in said second mixture in a weight ratio of about 95:3.5:1.5 and wherein said minor amount is an amount corresponding to a weight percent of said precursor mixture within the range from about 2.50 to about 2.83.

7. A composition according to claim 1, wherein said first component is molybdenum, wherein said third component is iron, wherein said boron carbide is $B_4C$, wherein the sizes of particles of molybdenum, nickel, iron, and $B_4C$ are on the order of microns, and wherein said minor amount is an amount corresponding to a weight percent of said precursor mixture within the range from about 5.0 to about 6.3 w/o $B_4C$.

8. A composition according to claim 7 wherein said minor amount is an amount corresponding to a weight percent of said precursor mixture within the range from about 5.0 to about 5.9 and wherein said molybdenum is present in a weight percent of about 91.

9. A cobalt-free, very hard, densified composition of matter having an angular-shaped grain structure which occupies at least about 40 volume percent of the total volume of said composition, wherein said densified composition is the hot-pressed reaction product of (1) a minor amount of at least one boron carbide component selected from the group consisting of (a) boron carbide and (b) boron and carbon, both B and C present in amounts effective to form said minor amount of boron carbide in situ, (2) nickel, (3) a first component selected from the group consisting of molybdenum, tungsten, mixtures thereof and alloys thereof, and (4) a second component selected from the group consisting of iron, copper, and mixtures thereof, and wherein said densified composition is characterized by having a Rockwell A hardness value of at least about 85.

10. A composition according to claim 9, wherein said minor amount is an amount no greater than about 6.3 weight percent of said hot-pressed reaction product, wherein said nickel, said first component, and said second component make up the balance of said hot-pressed reaction product, wherein said first component is an amount within the range from about 90 to about 97 weight percent of said balance when said first component is tungsten, and wherein molybdenum can be substituted for tungsten on a mole-for-mole basis.

11. A composition according to claim 10, wherein said first component is tungsten, wherein said second component is iron, wherein said boron carbide component is $B_4C$, and wherein said minor amount is an amount which corresponds to a weight percent of said composition prior to hot-pressing within the range from about 1.5 to about 4.0.

12. A composition according to claim 11, wherein said minor amount is an amount corresponding to a weight percent of the weight of said composition within the range from about 1.5 to about 3.0.

13. A composition according to claim 12, wherein said minor amount is a weight percent of the weight of said composition within the range from about 2.40 to about 2.85 and where said composition is characterized by having a hardness of at least 90 $R_A$.

14. A composition according to claim 12 characterized by having a hardness of about 85 $R_A$ and a fracture toughness value of about 12 Megapascal $\sqrt{\text{meter}}$, as measured by use of a Fractometer I® on a short rod.

15. A composition according to claim 10, wherein said first component is molbdenum, wherein said second component is iron, wherein said boron carbide component is $B_4C$, and wherein said $B_4C$ is present in an amount corresponding to a weight percent of said composition prior to hot-pressing within the range from about 5.0 to about 6.3.

16. A composition according to claim 10, wherein the relative weight ratio of said nickel:said second component lies within the range from about 3.5 to about 1.5.

17. A cobalt-free, very hard, densified composition of matter having an angular-shaped grain structure which occupies at least about 40 volume percent of the total volume of said composition, wherein said densified composition is the hot-pressed reaction product of (1) a minor amount of at least one boron carbide component selected from the group consisting of (a) boron carbide and (b) boron and carbon, both boron and carbon present in amounts effective to form said minor amount of boron carbide in situ, wherein said boron carbide component is $B_4C$, (2) nickel, (3) molybdenum, and (4) iron, wherein said densified composition is characterized by having a Rockwell A hardness value of at least about 85, wherein said molybdenum, said nickel, and said iron are present in said composition in a weight ratio of about 90.9:6.4:2.7 and wherein said $B_4C$ is present in an amount corresponding to a weight percent of said composition prior to hot-pressing within the range from about 5.0 to about 5.9.

18. A method of increasing the hardness of an alloy having a rounded grain shape and being formed from a first component selected from the group consisting of molbdenum, tungsten, mixtures thereof, and alloys thereof, a second component which is nickel, and a third component selected from the group consisting of iron, copper, and mixtures thereof, said method comprising:

(a) combining a minor amount of a powdered boron carbide component selected from the group consisting of
  (i) boron carbide and
  (ii) boron and carbon with a major amount of a powder of said alloy, so as to obtain a combined mixture; and (b) then subjecting said combined mixture to heat and pressure effective to form a hard, densified composition, wherein said minor amount is a weight percent of said combined mixture within the range from about 1.5 to about 6.3 and wherein said major amount is a weight percent of said combined mixture within the range from about 93.7 to about 98.5.

19. A method according to claim 18, wherein said boron carbide is $B_4C$ and wherein said minor amount is an amount corresponding to about 1.5 to about 4.0 weight percent of said combined mixture.

20. A method according to claim 18, wherein said tungsten is used to form said alloy in an amount corresponding to a weight percent of said alloy within the range from about 90 to about 97 and wherein said iron and said nickel are used to form said alloy in a combined amount corresponding to a weight percent of said alloy within the range from about 10 to about 3.

21. A method according to claim 18, wherein said alloy consists of molybdenum, nickel, and iron.

22. A method according to claim 21, wherein said boron carbide is $B_4C$ and wherein said minor amount is an amount corresponding to about 5.0 to about 6.3 weight percent of said combined mixture.

23. A method according to claim 20, wherein the relative weight ratio of said nickel:said second component lies within the range from about 3.5 to about 1.5.

24. A method according to claim 22, wherein the relative weight ratio of said nickel:said second component lies within the range from about 3.5 to about 1.5.

25. A method of producing a hard composition, said method comprising:

(a) mixing powders so as to obtain a first mixture consisting essentially of (1) a first component selected from the group consisting of tungsten, molybdenum, mixtures thereof and alloys thereof, (2) a second component consisting of nickel, and (3) a third component selected from the group consisting of iron, copper, and mixtures thereof, wherein said first component is an amount within the range from about 90 to about 97 weight percent of said first mixture when said first component is tungsten, wherein the sum of the amounts of said second component and of said third component is within the range from about 3 to about 10 weight percent of said first mixture, and wherein molybdenum can be substituted for tungsten on a mole-for-mole basis;

(b) combining about 1.5 to about 6.3 weight percent of powdered boron carbide with about 93.7 to about 98.5 weight percent of said first mixture, so as to obtain a combined mixture; and then (c) applying both heat and pressure to said combined mixture effective to form said hard composition.

26. A method according to claim 23, wherein said heat and said pressure are applied to said combined mixture simultaneously.

27. A method according to claim 25, wherein said pressure is applied to said combined mixture before said heat is applied.

28. A method according to claim 26 or claim 27, wherein said first component is tungsten, wherein said third component is iron, wherein said tungsten, said nickel, and said iron are elemental powders, wherein said boron carbide is $B_4C$, and wherein about 1.5 to about 4.0 weight percent of said $B_4C$ is combined with about 96 to about 98.5 weight percent of said first mixture.

29. A method of producing a hard composition, said method comprising:

(a) mixing powders so as to obtain a first mixture consisting essentially of (1) tungsten, (2) nickel, and (3) iron, wherein said tungsten, said nickel, and said iron are elemental powders;

(b) combining about 1.5 to about 4.0 weight percent of powdered $B_4C$ with about 96 to about 98.5 weight percent of said first mixture, so as to obtain a combined mixture; and then (c) applying both heat and pressure to said combined mixture effective to form said hard composition, wherein said first mixture consists of about 90 to about 97 weight percent tungsten and about 10 to about 3 weight percent of a mixture of nickel and iron having a weight ratio of nickel:iron within the range from about 3.5 to about 1.5.

30. A method according to claim 29, wherein said $B_4C$ is present in said combined mixture in an amount corresponding to about 2.5 to about 3.0 weight percent of said combined mixture.

31. A method according to claim 26 or claim 27, wherein said first component is molybdenum, wherein said third component is iron, and wherein said molybdenum, said nickel, and said iron are elemental powders.

32. A method according to claim 31, wherein said $B_4C$ is present in said combined mixture in an amount corresponding to about 5.0 to about 6.3 weight percent of said combined mixture, and wherein said first mixture consists of about 91 weight percent molybdenum and about 9 weight percent of a mixture of nickel and iron.

33. A method according to claim 32, wherein said $B_4C$ is present in said combined mixture in an amount corresponding to about 5.0 weight percent.

34. A method according to claim 32, wherein said $B_4C$ is present in said combined mixture in an amount corresponding to about 5.9 weight percent of said combined mixture and wherein the relative weight ratio of nickel:iron in said first mixture is within the range from about 3.5 to about 1.5.

35. An article of manufacture comprising a composition according to claim 9.

36. An article of manufacture comprising a composition according to claim 11.

37. An article of manufacture comprising a composition according to claim 13.

38. An article of manufacture comprising a composition according to claim 15.

39. An article of manufacture comprising a composition according to claim 17.

40. A hard, densified composition formed by hot-pressing a composition according to claim 2 or claim 3.

41. A hard, densified composition formed by hot-pressing a composition according to claim 5 or claim 6.

42. A hard, densified composition formed by hot-pressing a composition according to claim 7 or claim 8.

* * * * *